United States Patent [19]

Makabe et al.

[11] 4,393,795

[45] Jul. 19, 1983

[54] ELECTRONIC SEWING MACHINE

[75] Inventors: Hachiro Makabe, Fussa; Kazuo Watanabe; Hideaki Takenoya, both of Hachioji; Toshiaki Kume, Tachikawa; Toshihide Kakinuma, Tokyo, all of Japan

[73] Assignee: Janome Sewing Machine Co. Ltd., Tokyo, Japan

[21] Appl. No.: 261,710

[22] Filed: May 8, 1981

Related U.S. Application Data

[63] Continuation of Ser. No. 96,573, Nov. 21, 1979, abandoned.

[30] Foreign Application Priority Data

Nov. 27, 1978 [JP] Japan ..... 53-145280

[51] Int. Cl.[3] ..... D05B 3/02

[52] U.S. Cl. ..... 112/158 E

[58] Field of Search ..... 112/158 E, 121.11, 121.12, 112/316, 317

[56] References Cited

U.S. PATENT DOCUMENTS

| | | | |
|---|---|---|---|
| 4,222,339 | 9/1980 | Iwako | 112/158 E |
| 4,227,472 | 10/1980 | Bergvall | 112/158 E |
| 4,236,469 | 12/1980 | Takenoya | 112/158 E |

*Primary Examiner*—Peter P. Nerbun

*Attorney, Agent, or Firm*—Michael J. Striker

[57] ABSTRACT

In electronic pattern stitch sewing machine lock stitches are produced prior to the initial and final stitch of a selected pattern without deforming the patterns. In this machine, under single setting operation conditions the setting of desired sewing parameters is made automatically for a basting operation.

2 Claims, 10 Drawing Figures

FIG. 6-A1
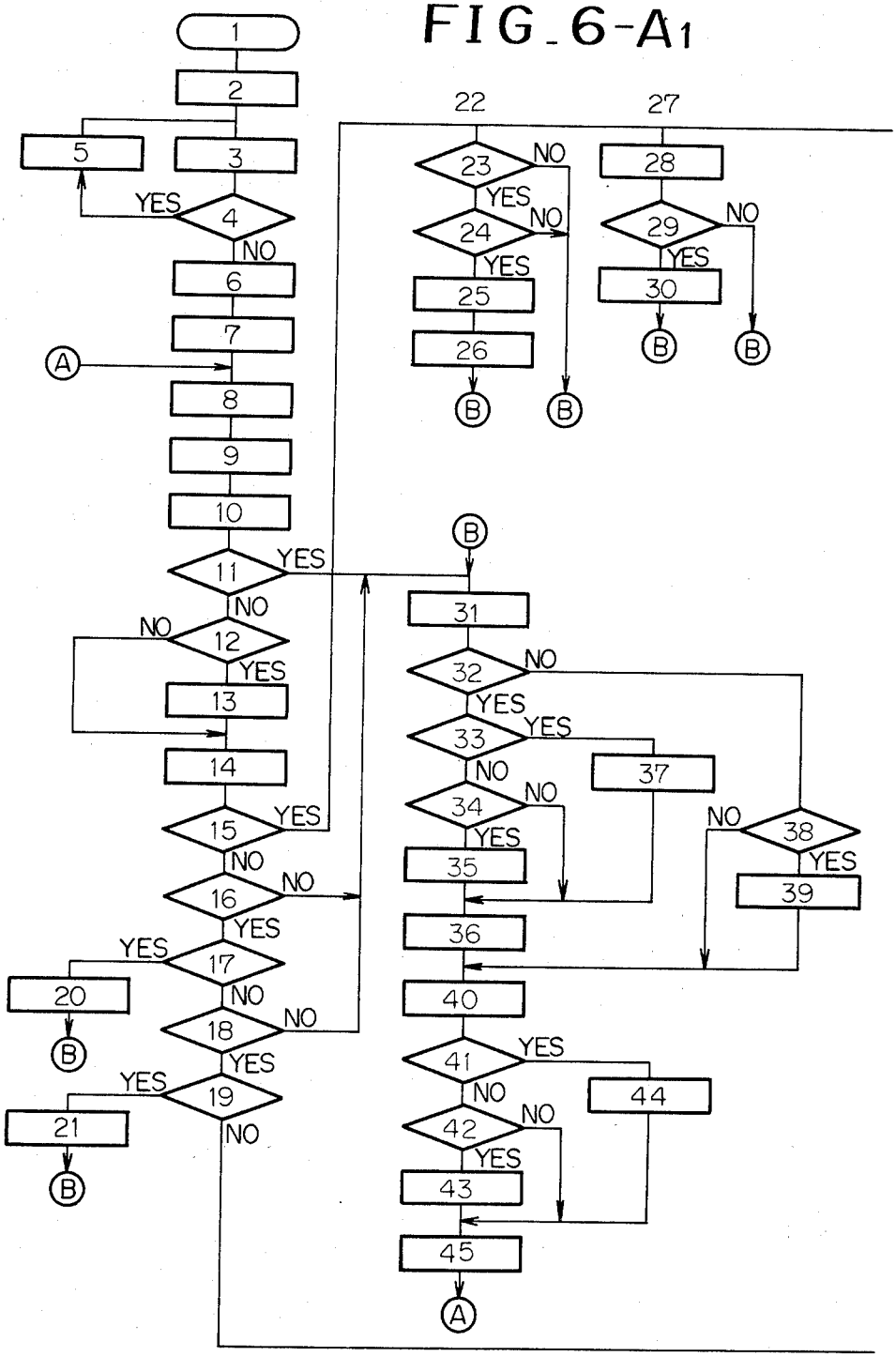

FIG_6-A2

1 : Start
2 : Power source ON
3 : Initial energization & reset of pulse motors PMw, PMF
4 : Test
5 : Test of circuit elements
6 : Data read-out of stitch adjusting dials VRw, VRF
7 : Straight stitching
8 : Indication lamp OFF
9 : Data read out of switch & detector
10 : Indication lamp OFF
11 : Brake is set & pulse motor energization setting timer T is operating
12 : Phase change
13 : Machine motor restrain detecting timer reset
14 : Phase checking
15 : Needle is at controlled phase
16 : Machine motor SM
17 : Feed dog is switched
18 : Pulse generator PDH is at H level
19 : Change of needle drop hole
20 : Feed dog is switched
21 : Change of needle drop hole
22 : Brake control phase
23 : Brake is ready
24 : Machine motor stopping speed
25 : Operation of brake
26 : Brake setting timer T interrupt
27 : Stitch adjusting dial read-out phase
28 : Date read out of stitch adjusting dials VRw, VRF
29 : Different from preceded data
30 : Data read out of dials VRw, VRF
31 : Switch data processing
32 : CC-operated
33 : Final step of buttonhole
34 : Memorized series patterns
35 : Indication lamps sequentially varied
36 : Machine motor starts
37 : Automatic buttonhole with data registered
38 : Controller released
39 : Brake is ready
40 : Motor speed adjustment
41 : Machine motor deenergized
42 : Machine motor SM restrain detecting timer is at set value
43 : Machine motor deenergized
44 : Machine motor restrain detecting timer reset
45 : Pulse motor power is reduced FIG_6-B1
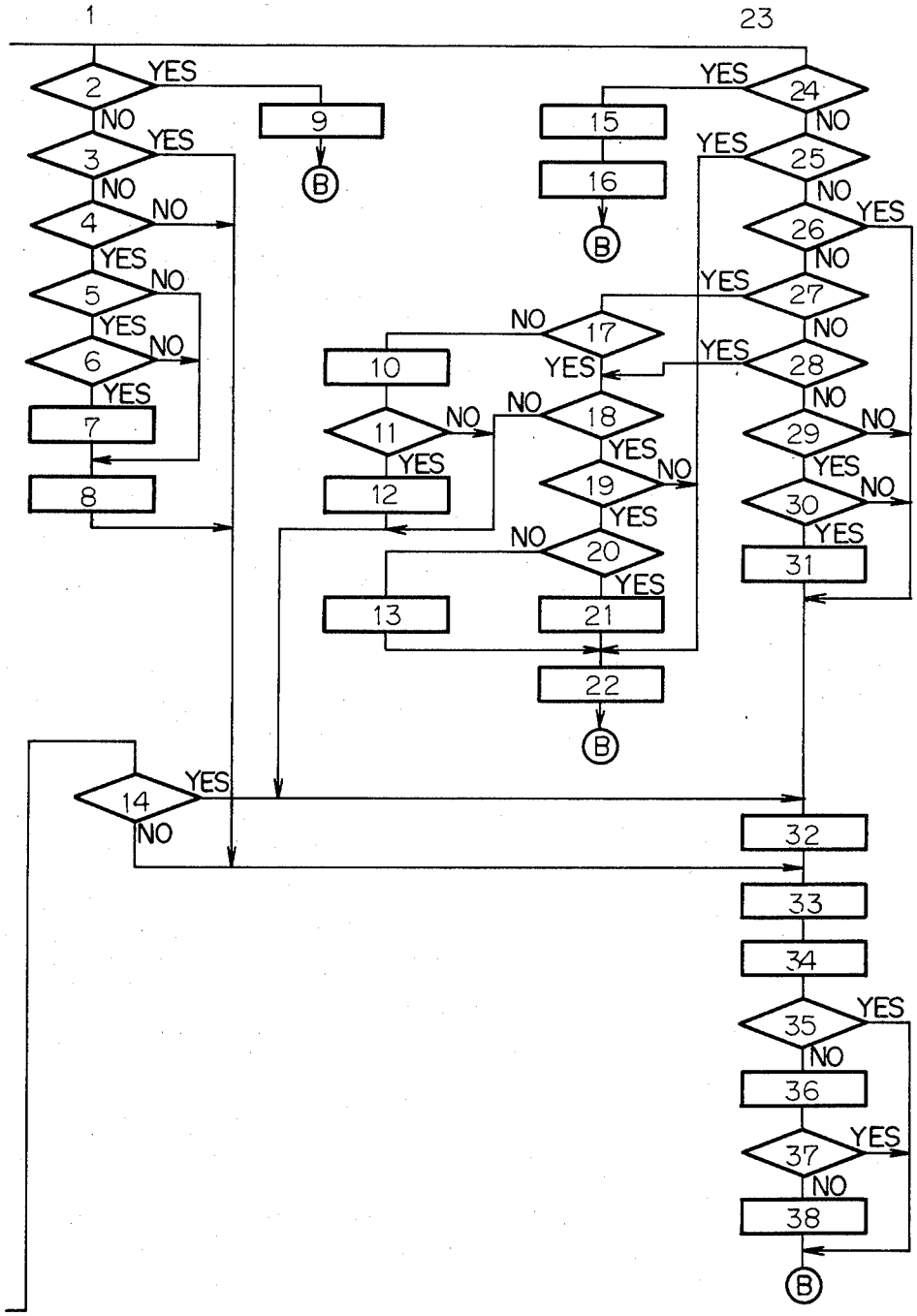

FIG_6-B2

1 : Feed control phace
2 : Feed dog switching
3 : Basting, buttonhole or finish-up stitches
4 : Reverse stitches
5 : Memorized series patterns
6 : One cycle is finished
7 : Preceded pattern
8 : Backward read out of ROM
9 : Feed dog switching
10 : Line-take stitches
11 : Stitch number set
12 : Next step
13 : Selected pattern
14 : Initial address of selected pattern
15 : Change of needle drop hole
16 : Brake is ready
17 : Final step of buttonhole stitches
18 : One cycle is finished
19 : Finish-up stitch
20 : Memorized series patterns
21 : Initial pattern
22 : Brake is ready
23 : Needle swing control phase
24 : Change of needle drop hole
25 : Basting stitch
26 : Reverse stitch
27 : Buttonhole stitch
28 : Finish-up stitch
29 : Memorized series patterns
30 : One cycle is finished
31 : Next one of series pattern
32 : Forward read out of ROM
33 : Determination of new coordinate
34 : Determination of step number of pulse motors PMw, PMF
35 : Step number is 0
36 : One step of pulse motors PMw, PMF
37 : Step number is 0
38 : Energization setting timer T interrupt 1 : Interruption start
2 : Brake interrupt
3 : Pulse motors PMw, PMF 1 step
4 : Step is 0
5 : Energization setting timer T interrupt
6 : RET

ELECTRONIC SEWING MACHINE

CROSS-REFERENCE TO RELATED APPLICATIONS

This application is a continuation of the application Ser. No. 096,573, filed Nov. 21, 1979, now abandoned.

BACKGROUND OF THE INVENTION

The invention relates to a sewing machine, and more particularly to an electronic sewing machine which has an electronic memory for storing stitch control data and other control data which are each processed by calculators to effectively control the various functions of the sewing machine for various stitching types. According to the invention, the sewing machine can be set by a single operation to produce a stitching type, for example, basting stitches, and also can be set easily from the finish-up stitches to other stitch patterns and vice versa.

Conventional sewing machines are set for basting stitches by various setting operations, for example, firstly by adjusting the fabric presser foot through a spring or solenoid device, secondly by lowering the feed dog below the needle plate, thereby to nullify the same, and thirdly by reducing the rotation speed of the sewing machine and by intermittently driving the sewing machine. In this case, if the sewing machine has a zig-zag stitching function, the laterally elongated needle dropping hole has to be reduced for straight stitching.

Moreover, the conventional sewing machine has a defect especially in producing the finish-up stitches. The finish-up stitches (also called lock stitches) are formed independently of the pattern stitches to prevent the thread from fraying. Therefore, if different patterns are stitched successively before and after the finish-up stitches, the proportions of the successively sewn patterns are often deformed in dependence upon the patterns to be stitched when the needle positions are not adjacent to each other at the junction of the different patterns.

The present invention has been provided to eliminate such defects and disadvantages of the prior art.

SUMMARY OF THE INVENTION

It is a primary object of the invention to select the basting stitches by a single setting operation; namely according to the invention, a single setting operation of the sewing machine provides a suitable pressure of the fabric presser foot, the change of the needle dropping hole from the laterally elongated zigzag stitching hole to a reduced straight stitching hole, the change of the fabric feeding device from the effective condition to the ineffective condition, and the intermittent drive of the sewing machine at reduced speed per depression of the machine controller, in which the needle stops at the upper dead point thereof.

It is another object of the invention to provide suitable finish-up stitches without deforming the patterns; namely according to the invention, if a pattern is selected prior to the selection of the finish-up stitches, a predetermined number of finish-up stitchs are made prior to stitching the initial and the last stitch of the selected pattern, whichever needle position the pattern may start from and whichever position it may terminate at, so as to prevent the stitch pattern from fraying at the initial and the last stitch thereof. When a predetermined number of the finish-up stitches are made at the end of the pattern, the sewing machine is automatically stopped with the needle brought to the upper dead point thereof. Then if the sewing machine is driven again, the same pattern is stitched again.

It is another object of the invention to provide a sewing machine which is easily operated.

The other features and advantages of the invention will be apparent from the following description of the invention in reference to the attached drawings.

Figure 7:
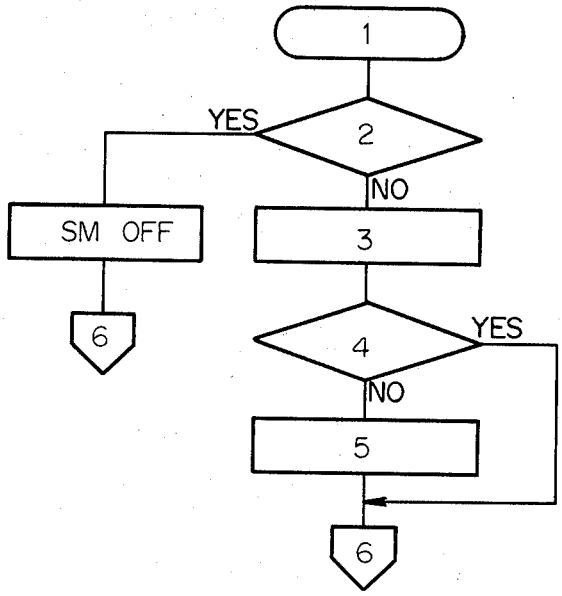

FIGS, 6-A1 and 6-B1 show a flow-chart indicating the operation of the sewing machine of the invention;

FIGS. 6-A2 and 6-B2 show the functional explanation of FIGS. 6-A1 and 6-B1; and FIG. 7 shows another flow-chart indicating the operation of the sewing machine in conjunction with FIGS. 6-A1 and 6-B1.

DETAILED DESCRIPTION OF THE INVENTION

Figure 1:
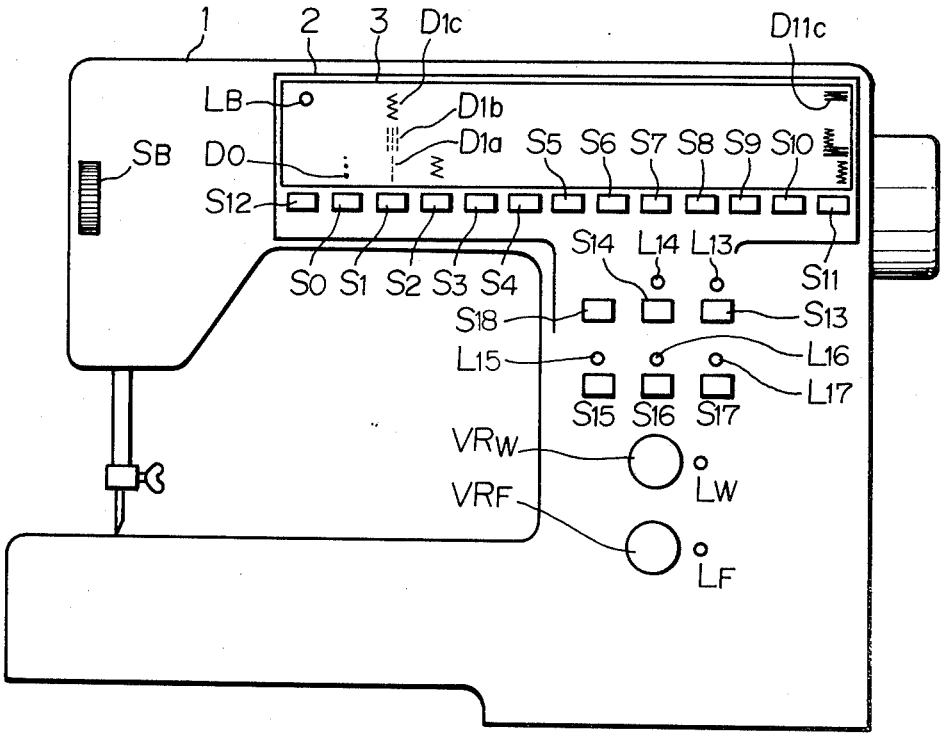
FIG. 1 shows a front elevational view of the sewing machine of the invention.

The invention will now be explained with reference to the attached drawings. In FIG. 1, the reference numeral 1 is a machine housing. The numeral 2 is a front panel in which there are laterally arranged a finish-up stitch selecting push button S0, a reverse stitch selecting push button S12 and pattern selecting-push buttons S1–S11. Reference numeral 3 identifies a translucent panel or plate which is printed with pattern indications D0, D1*a*–D11*c* though the patterns are only partially shown. Lamps are each arranged for lighting the pattern indications D0, D1*a*–D11*c* from the rear side of the plate 3 when the patterns are each selected. When any one of the buttons S0–S11 is pushed, one of the pattern indications above the button is lighted. Namely when the button S1 is pushed the indication D1*a* is lighted to indicate the selection. If the same button is again pushed, the indication D1*b* is lighted, and when this button is once more pushed, the pattern D1*c* is selected. The button S11 is for selecting the three steps of a buttonhole. The buttonhole is completed when the last pattern is stitched and then the finish-up stitches are subsequently made. The other push buttons S1–S10 are for selecting the patterns, and the lower indication D1*a* at the push button S1 is for the straight stitching. The patterns which require to be sewn at the maximum permissible stitching speeds are provided at such stitching speed limitations. S12 is a push button for the reverse stitch to be effected by reversing the fabric feed for the patterns selected by the buttons S1–S10. Reference numeral S13 is a push button for turning the patterns, especially the asymmetrical patterns to the right and left side around the center needle position numeral. S14 is a push button for memorizing a plurality of different patterns to be sequentially stitched in the order of pattern selections by the push buttons S1–S10 and S13. Numeral S15 is a push button for lowering the feed dog to the ineffective position under the needle plate when the button attaching stitch or embroidering stitch is made. Numeral S16 is a push button for employing a twin-needle and for limiting the maximum lateral amplitude of the needle. Numeral S17 is a push button for a lower speed stitching to limit the controller-controlled maximum speed of the machine to a predetermined low speed. Numeral S18 is a push button for cancelling an order by any one of the buttons S13–S17. Character VRw is a dial for adjusting the lateral swinging width of the needle. The dial is pushed to make the needle swingable, and is rotated to adjust the swinging width of the needle. Character $VR_F$ is a dial for adjusting the stitch length. Numerals L13–L17 $L_W$, $L_F$ are lamps each indicating that the above mentioned operations are available. Character $S_B$ is a dial for selecting the pressing degrees of the fabric presser foot. The dial is rotated to a predetermined position to select the basting stitch and a comparatively weak pressure of the fabric presser foot PF, and also to drop the feed dog to the ineffective position under the needle plate. In reference to FIGS. 2 and 3, the reference numeral 4 is an upper shaft which is driven by a motor (not shown) to vertically move the needle 6 via the needle bar 5. Character $PD_H$ is a synchronous pulse generator including a detector $PD_B$ to detect the needle position for controlling the swinging movement of the needle and for changing the needle dropping hole from the hole for straight stitching to zigzag stitching and vice versa and for controlling the brake mechanism to stop the machine motor. Said pulse generator is composed of a photo-generator 7 secured to the machine housing 1 and a photointerrupter 8 mounted on the shaft 4 for rotation therewith, and issues a high (H) level signal per rotation of the upper shaft 4 when the needle 6 is above the needle plate 9. The photointerrupter 8 includes a projection 8A having an end 8B to detect the braking phase of the sewing machine. $PD_L$ is a synchronous pulse generator for detecting the lower position of the needle 6 for controlling the feeding device and for lowering the feed dog to the inoperative position under the needle plate 9 or returning the same to the operative position. The pulse generator $PD_L$ is similarly composed of a photogenerator 10 mounted on the machine housing 1 and a photointerrupter 11 mounted on the upper shaft 4 for rotation therewith. The pulse generator $PD_L$ generates a high level signal (H) in a phase when the needle 6 is under the needle plate 9. SD is a sewing machine speed detector composed of a photogenerator 12 mounted on the machine housing 1 and a photointerrupter 13 mounted on the upper shaft 4 for rotation therewith. The photointerrupter 13 has several cutouts 14 therearound to produce pulse signals in proportion to the rotations of the upper shaft 4. CB is a control device. PMw is a pulse motor for controlling the swinging movement of the needle 6. The shaft (not shown) of the pulse motor PMw is operatively connected to the needle bar 5 through a link 15 and a transmission rod 17.

Figure 3:
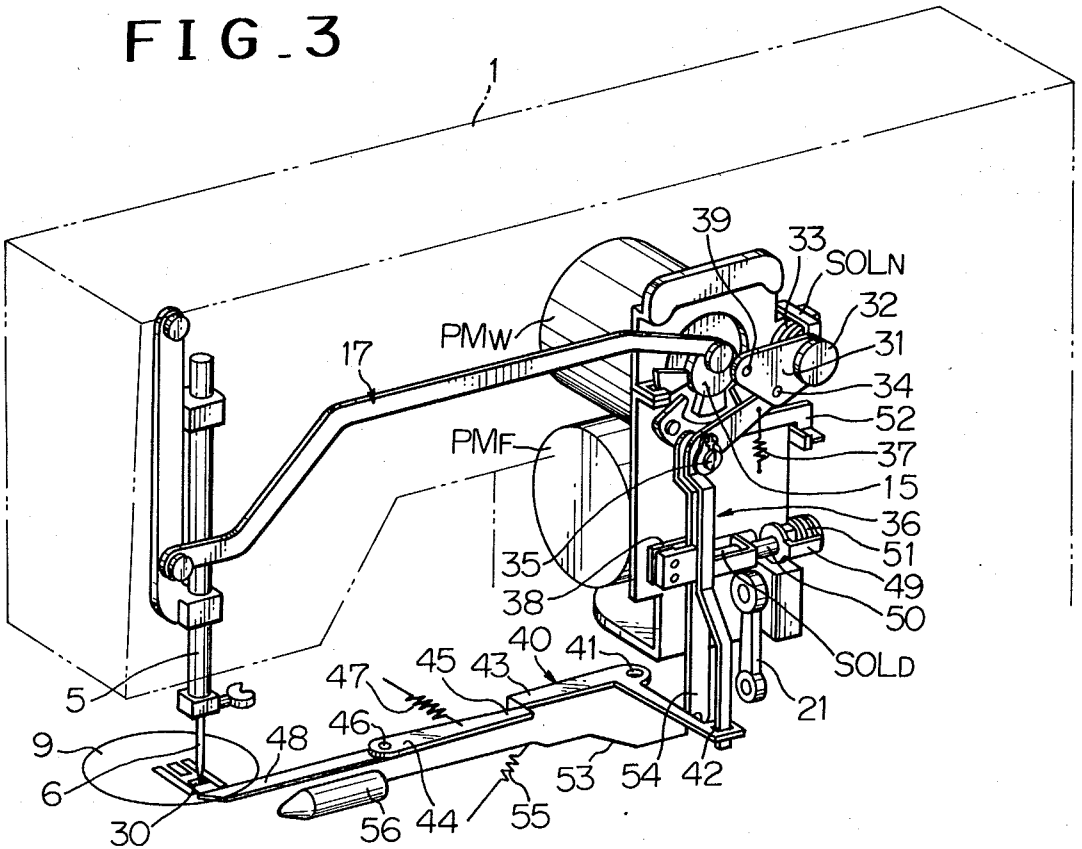

The link 15 has a stopper element 18, the rotation range of which is limited by a stopper 19. Numeral 20 is a segment shaped photointerrupter mounted on the shaft of the pulse motor PMw and operated in association with a photogenerator PDw to detected a lateral swinging position of the needle. $PM_F$ is a pulse motor controlling the fabric feed, and the rotation of this motor controls the horizontal feeding movement of the feed dog 28 via a link 21 swingable by belt connection (not shown) with this motor, a feed adjuster 22, a fork rod 23, a connecting link 24, a horizontal feeding shaft 25, a horizontal feeding link 26 and a feed plate 27. Numeral 29 is a lower shaft rotated in synchronism with the upper shaft 4 to rotate a thread loop taker (not shown). The pulse motor $PM_F$ has a segment shaped photointerrupter and photogenerator (not shown) as in the pulse motor PMw to detect the angular position of the feed adjuster 22. The pulse motor PMw also serves to change the needle dropping hole 30 of the needle plate 9 from a laterally elongated hole for stitching the patterns to a reduced circular hole for producing the straight stitch. Numeral 31 is an arm for changing the needle hole. The arm 31 is rotatably pivoted around a switching shaft 32 and is movable in the direction parallel with the shaft of the pulse motor PMw and is usually biased toward the viewer in FIG. 3. The switching shaft 32 is connected to a plunger of a clutch solenoid $SOL_N$ for switching the needle hole. When the solenoid is energized, the arm 31 is moved toward the pulse motor PMw against a spring 33. The switching arm 31 has an engaging pin 34 which is in engagement with a needle hole switching lever 36 pivoted to the shaft 35, and the switching plate 36 is biased by a spring 37 into the clockwise direction and is in contact with a stopper 38. This spring 37 biases the switching arm 31 into the counterclockwise direction. At an angular position when the switching plate 36 contacts the stopper 38, if the swinging link 15 causes the swinging rod 17 to move the needdle bar 5 to the right at the maximum (the maximum control position in the clockwise direction of the pulse motor PMw), a pin 39 engages the swinging link 15 by energization of the solenoid $SOL_N$ so as to transmit the rotation of the pulse motor PMw to the switching arm 31, and the needle dropping hole 30 is charged for the straight stitch, and then the solenoid $SOL_N$ is deenergized. In other positions, the switching arm 31 is not moved to the front side in the drawing even though the solenoid $SOL_N$ is deenergized, and remains in engagement with the pulse motor PMw. Numeral 40 is an intermediate lever pivoted at 41 to the machine housing 1, one end 42 of which is connected to the switching lever 36 and the other end 43 of which is in contact with a lever 44 at its one end 45. The lever 44 is pivoted at 46 to the machine housing 1 and is biased by a spring 47 into the counterclockwise direction, and this spring force pulls the other end 48 of the lever 44 toward the viewer as shown in FIG. 3 in which the laterally elongated needle dropping hole 30 is provided for zigzag stitching. On the other hand, if the lever 44 is turned in the counterclockwise direction against the spring 47, the slide plate element (not shown) at the end 48 of the lever 45 partially closes the laterally elongated needle dropping hole 30 to change the same to a reduced circular hole for straight stitching. This is effected by rotation of the pulse motor PMw. The pulse motor $PM_F$ is also operated to make the feed dog 28 inoperative by receiving an order from the dial $S_B$ for selecting the basting stitches or from the push button S15 or from the push button S15 for lowering the feed dog. Numeral 49 is an arm for switching the feed dog. The arm 49 is mounted around a switching shaft 50, and is movable together with the switching shaft 50 in parallel to the shaft of the pulse motor $PM_F$ and is provided with a spring 51. The switching shaft 50 is directly connected to a plunger (not shown) of the clutch solenoid $SOL_D$ for switching the feed dog. If this solenoid is energized, it moves the switching arm 49 toward the pulse motor $PM_F$ against the spring 51. Numeral 52 is a lever for switching the feed dog, pivotedly mounted on the shaft 35, and the switching arm 49 releasably engages the pulse motor $PM_F$ in the same manner as the switching arm 31, so as to transmit the rotation of said pulse motor to the switching lever 52. That is, the switching lever 52 is adapted to contact the stopper 38, and in such an angular position when the pulse motor $PM_F$ is rotated to the maximum control position in the clockwise direction, the rotation of the pulse motor $PM_F$ is transmitted to the switching arm 49 by the energization of the solenoid $SOL_D$, and the feed dog 28 is lower under the surface of the needle plate 9 by the rotation of the pulse motor and subsequently the solenoid is deenergized. In the other angular position the arm 49 is kept in engagement with the pulse motor $PM_F$ if the solenoid $SOL_D$ is deenergized. Numeral 53 is a plunger rod connecting the lower end 54 of the switching lever 52 to a plunger 56, and biased by a spring 55 in the left direction.

Figure 4:
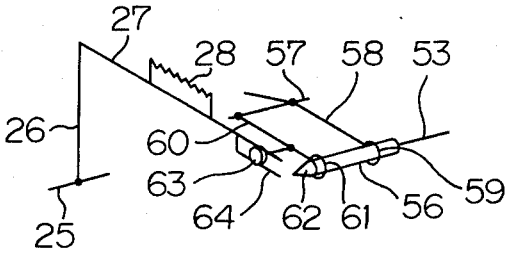
FIG. 4 shows an outline view of the feed mechanism concerning the invention.

FIG. 4 shows the relation between the feeding device and the plunger 56. As the switching lever 52 is turned, the plunger 56 is axially displaced into or out of holes 59, 61 formed respectively at the ends of a vertically swingable link 58 and a vertically swingable arm 60. The link 58 is vertically swingable in synchronism with rotaion of the sewing machine by a rocking shaft 57, and the arm 60 is at the end thereof loosely mounted on the rocking shaft 57. The verticaly swingable arm 60 has a lateral pin 63 which is inserted into a forked part 64 of a base 27 supporting a feed dog 28. One end of the base 27 is pivotally connected to the upper end of a link 26 which is swingable by a rocking shaft 25 to horizontally reciprocate the base 27 in synchronism with rotation of the sewing machine. Thus the feed dog 28 feeds the sewn fabric by a combination movement of the base 27 which is vertically and horizontally reciprocated. It is, therefore, apparent that the feed dog 28 is vertically moved when the plunger 7 is inserted into the holes 59, 61 of the vertically swingable link 58 and the arm 60. It is also apparent that the feed dog 28 is dropped below the level of the needle plate 9 and becomes vertically inoperative if the plunger 56 is displaced out of the holes 59, 61. The axial movement of the plunger 56 is effected by rotation of the pulse motor $PM_F$.

Figure 2:
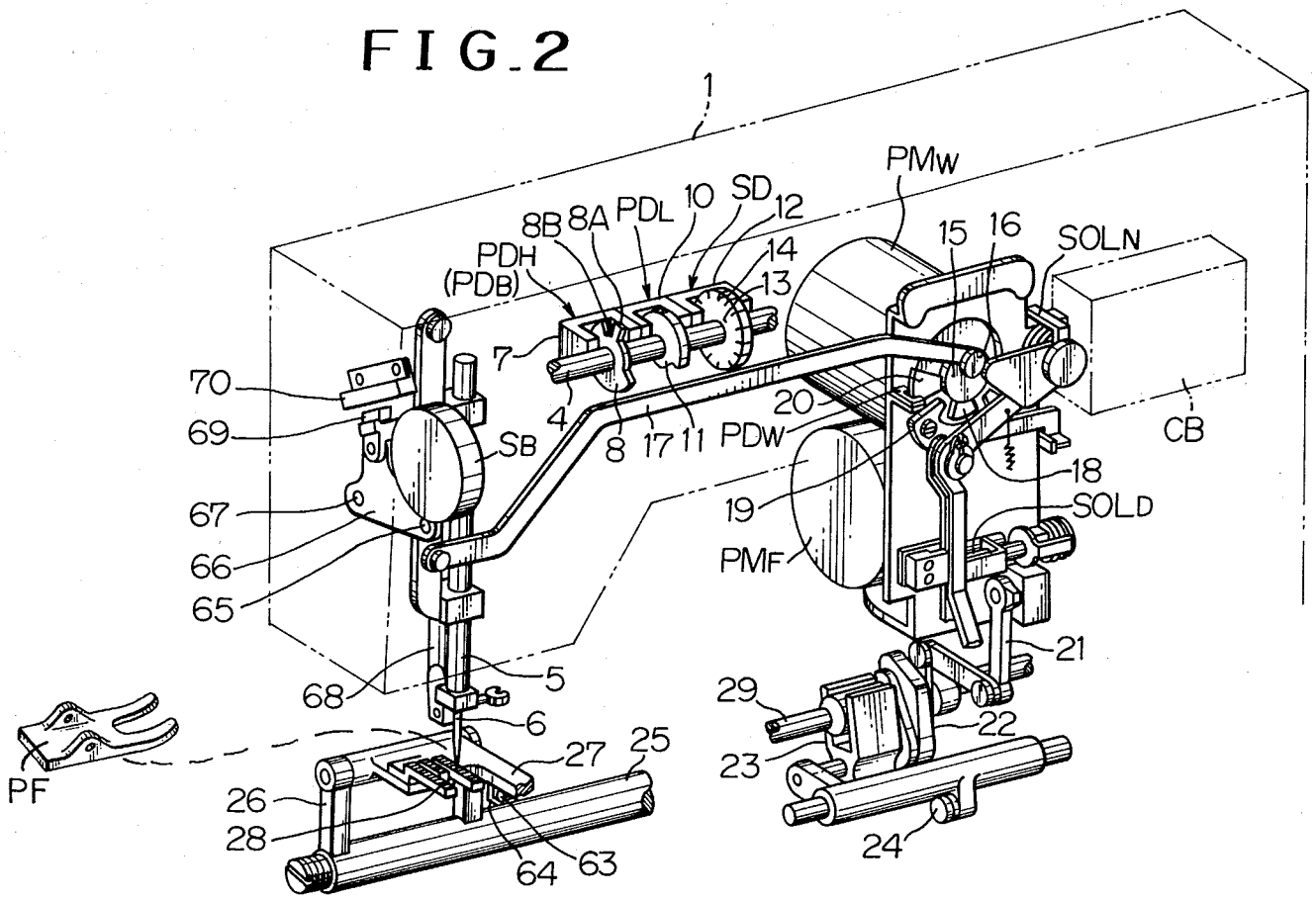
FIGS. 2 and 3 show the inner mechanisms of the sewing machine respectively concerning the invention.

As shown in FIG. 2, the adjusting dial SB is provided with a cam (not shown) for engaging a follower 66 which is pivoted at 65 to the machine housing 1. The follower 66 is provided with a pressure adjusting pin 67 to be vertically moved by the rotation of the selecting dial $S_B$ for adjusting the pressure of a spring (not shown) so that the pressure of the fabric presser bar may be adjusted. The follower 66 is also provided with a magnet 69, and the selecting dial $S_B$ is rotated stepwise for opening and closing a leading switch 70 which is to give an order of the basting stitches to the control device CB. FIG. 2 shows a condition in which the follower 66 is rotated at the maximum to the clockwise direction where the pressure is at the minimum and the switch 70 is closed to order the basting stitch. In other conditions, the switch 70 is opened.

Figure 5:
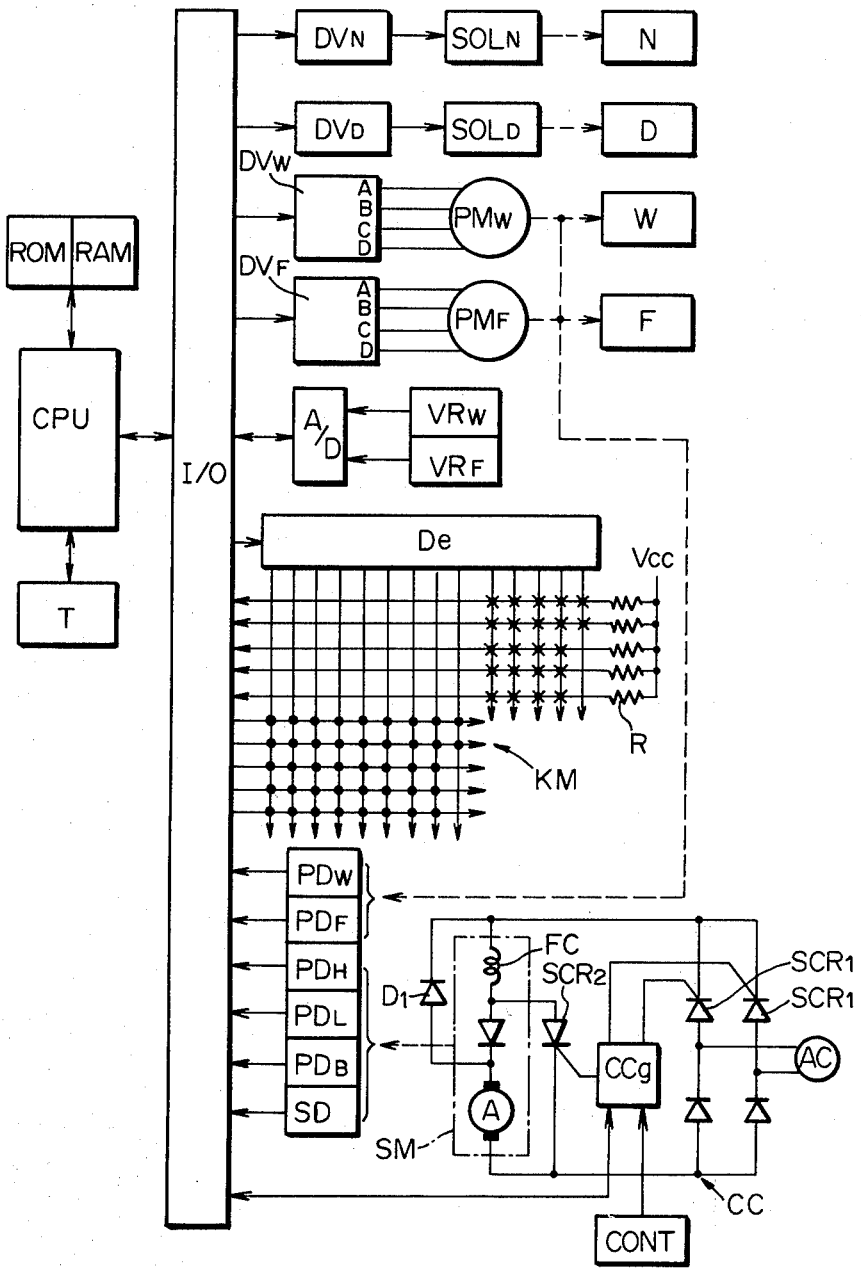
FIG. 5 shows a block diagram of a control circuit of the invention.

FIG. 5 is a control block diagram of the invention, showing the main elements housed in the controlling device CB. Solid lines show electrical connections of the respective parts, and arrows show control directions, and chain lines show mechanical connections. ROM is an electronic read-only memory which stores stitch control signals for producing stitch patterns selected by the pattern selecting buttons S0–S11, and program control for effecting respective programms. CPU is a central processing unit for controlling the programms. RAM is a random access memory for temporarily storing processes and results of the programms. T is a timer, and I/O is an input-output port. KM is a key matrix which scanningly reads out the signals of the buttons S0–S18 in accordance to the order of CPU. De is a decoder, Vcc is a control power source, and R is a pull-up resistor. DVw and $DV_F$ are driving devices for the pulse motors controlling lateral needle amplitude and the fabric feed. These driving devices are provided with power sources to energize or deenergize a single or a plurality of coils A, B, C, D of different phases composing the respective pulse motors for controlling the needle and the fabric feed. In case of a bipolar system, these drive devices control the flow directions of the electric current so as to drive these pulse motors in the forward or backward directions. The driving devices are also respectively provided with circuits for reducing the electric power at the stopping time. The pulse motor PMw operates a needle swinging mechanism W including the transmission rod 17, and the pulse motor $PM_F$ operates a fabric feeding mechanism F including the feed adjuster 22. When the control power source is supplied to activate the control circuit shown in FIG. 5, the central processing unit CPU detects if the pulse generators PDw and $PD_F$ are in the condition for positioning the pulse motors PMw, $PM_F$ respectively, and thus the unit CPU rotates the pulse motors until they come to the reset positions, and these positions are registered. A clutch solenoid $SOL_N$ is controlled and driven by a driving device $DV_N$ including the solenoid driving power source in accordance with the signal from CPU, and operates the motor PMw to activate the needle dropping hole changing mechanism N prior to a stitching operation. A clutch solenoid $SOL_D$ for switching the feed dog is controlled and driven prior to stitching by a driving device $DV_D$, and operates the pulse motor $PM_F$ to activate the feed dog switching device D. A/D is an analog-digital converter which converts the signals of the needle swinging adjusting dial VRw and from the stitch length adjusting dial $VR_F$ into the digital values and applies the latter to the CPU. CC is a machine motor control part connected to the machine motor drive power source AC. The machine motor control part is operated by a machine controller CONT, so that the gate control part CCg may drive the machine motor SM through control thyristors SCR1, SCR1. Namely, the gate control part CCg detects the operation of the controller CONT and supplies a signal to the CPU which causes the control part CC to receive a speed control signal by the operation of the controller CONT. Said machine motor control part CC controls the control thyristor SCR2 which is activated by the signal from the CPU when the controller CONT applies a release signal to the CPU. (A) is an armature of the machine motor SM. FC is a field magnet, and D1 is a diode. Further, the machine motor control part CC makes a feed-back control of the machine motor SM by means of the speed signal of a speed detector SD which detects the rotation speed of the upper shaft 4. Namely, the speed detector SD applies to the CPU a low speed rotation signal designated for stopping the needle at a predetermined position and a signal of the pulse generator $PD_B$ for detecting a braking phase by the rotating phase of the upper shaft 4. Then the CPU is operated to cause the machine motor SM to stop the needle at the upper dead point thereof. $PD_H$ is a detector for detecting the needle at the upper position, and gives to the CPU a signal for determining the control time of the pulse motor PMw for needle control. $PD_L$ is a detector for detecting the needle at the lower position and gives a signal for determining a driving time of the pulse motor $PM_F$ for the feed control. With respect to the read-out control of the stitch controlling signals, ROM stores, in the same address and in the matched condition, the stitch control signals composed of the needle amplitude control signals and the fabric feed control signals, and the address signals for reading out the next stitch control signals. The ROM is operated to transfer these stitch control signals selectively to the RAM, and at the same time applies the next-address signal to the address input thereof, so that the CPU may read out these stitch control signals and do various calculations each time it receives a signal from the detector $PD_H$. The needle and feed control signals temporarily stored in RAM are instantaneously read out respectively by the signals of the detectors $PD_H$ and $PD_L$ to drive the pulse motors PMw, $PM_F$. In regard to the matched needle control signals and the feed control signals, one of the control signals may not be necessary, depending on a pattern to be formed. In this case, such vacant spaces of the rom may be used to store additional control signals for other patterns. The other space of ROM may be used to store the stitch control signals which are used commonly to each stitch of a single or a plurality of patterns in such a manner that they may be read out by an order from CPU as required.

The present invention is composed as mentioned above, and the operation of the invention is as follows: With reference to FIGS. 6-A1, 6-B1 and 6-A2 and 6-B2 showing a flowchart for explaining the operation of the control circuit shown in FIG. 5, if AC power source is turned ON, each of the control power sources is turned ON accordingly, and the program is started around the CPU to reset each of the respective elements shown in FIG. 4. If, e.g., A phase and D phase are initially energized, the pulse motors PMw, $PM_F$ are set to predetermined positions respectively, and the pulse generators PDw, $PD_F$ are detected as ON or OFF. That is, the photointerrupter 20 is provided in such a suitable manner that there will be no switching point between ON and OFF when these pulse motors are at the set positions respectively. The energized phases are successively changed to rotate the pulse motors PMw, $PM_F$ to said switching side by the program in accordance with said discrimination, and the pulse motors are stopped at the respective positions, by the energizations of the A and D phases, which are reached at first after passing the respective switching points. Those are the reset positions respectively of the pulse motors, and these reset positions are different from each other by the ON and OFF switching points in dependence upon the discriminating ON or OFF signal of the pulse generators at the initial energization of the pulse motors. These reset positions of the pulse motors are stored in RAM (subsequent processing values are similarly stored in RAM) as the starting phases in the subsequent control of the pulse motors. Then it is discriminated whether or not an order is given to test if there may be troubles in the circuit elements. If there are troubles, the tests are carried out on the elements, and when the testing order ceases after the test, the value of dial VRw of adjusting the stitching width and the value of dial $VR_F$ of adjusting the stitching length are read out. This is the initial reading-out, and after once reading out, the values of these dials are checked in other steps. These dials are made effective by the pushing operation, but the reading-out is performed, irrespectively of this pushing. This reading-out is made by digitally measuring the charging time of a capacitor by the order of CPU until it reaches a predetermined voltage level, the capacitor being charged through a resistor, the value of which is adjusted by the dials VRw, $VR_F$. That is, by counting up, the digital-analog conversion is made to permit subsequent calculation processing. Each of functions is made for the straight stitching which is most usually employed when the pattern selecting switches S0–S11 are not operated. Namely, the needle 6 is moved to the center of the lateral swinging amplitude thereof and the needle dropping hole is adjusted to a reduced circular hole for the straight stitch, and the indicating lamps L12–L17, Lw, $L_F$ for the pattern indications D0, **D1*a*–D11*c* are all turned OFF. This is done by the key matrix KM in FIG. 5, in which any control lines having lamps in x-direction (output of a decoder De) and y-direction (output of the input-output port I/O) will not be made operative simultaneously of the crossing points indicated by O marks to be scanned. Then the reading-out is performed on the operations of the pattern selecting switches S0–S11, the functioning switches S12–S18, the switches of the stitch adjusters VRw, the operations of the basting switches $SW_B$ and the detected values of the detectors PDw, $PD_F$, $PD_H$, $PD_L$, $PD_B$, SD. Said reading-out of the switches is done by detecting a short-circuit of a certain individual crossing point or of a plurality of crossing points indicated by X marks of the control lines having these switches and directed in the x-direction (output of the decoder De) and the y-direction (output of the input-output port I/O) by operating the switches. Said signals of the detectors are read out at the H level or L level. The pulses issued per a unit time by the speed detector SD are processed as a speed signal by a following program. In a condition in which the pattern selecting switches and other switches are not operated, the same data processing is performed as the straight stitching is selected by the first operation of the pattern selecting switch S1 in the following program. Then the lamp or lamps are lighted in dependence upon the operation or operations of the switches including the operating number thereof. This is because one or more cross points are made operative in the key matrix KM. When any one of the switches is not operated, the straight stitching indication lamp D1*a* is lighted. It is discriminated whether a later mentioned timer T is operative or not, and if it is operative, then it is discriminated whether or not the signal of the needle position detector $PD_H$ or $PD_L$ is charged in time in order to deal with the machine motor SM in case it has some troubles, that is, it is discriminated whether the phase is changed or not. If the machine motor SM is not changed in phase in the conductive condition under a later mentioned process, the discrimination signal "NO" keeps operative the timer for detecting the restraint of the machine motor, and if the machine motor SM is changed in phase, which means a normal driving of the sewing motor, the timer is reset each time phase changes are detected. Then a phase check is made so as to discriminate the switching points or levels of the signals previously read out of the needle upper position detector $PD_H$ of the braking phase detector $PD_B$ and of the needle lower position detector $PD_L$, and these phases are discriminated if they are each control phases. If there are not rising signals or descending signals in these discriminations of the detectors $PD_H$, $PD_L$ and $PD_B$, the results of reading out OFF or ON of the switches S0–S18 and the controller CONT are processed. Since it is not discriminated whether or not the phase is the controlling operation when the timer T is operative, said reading-out results are processed. When the machine motor SM is not energized, it is discriminated if the feed dog 28 should be dropped below the needle plate 29 or returned to the operative position, and such programming is made. The feed dog dropping operation is made by energization of the solenoid $SOL_D$, and the feed dog recovering operation is made by operating the pulse motor $PM_F$ and the machine motor SM. After the switch data is processed, it is detected if the controller CONT is ON or OFF, that is, when the controller is released, preparation is made to brake the machine motor SM. If the controller remains ON, the speed of the machine motor is controlled without preparing the braking. The control part CC is controlled by the gate control part CCg. When the control part CC receives a signal indicating the shift from OFF to ON of the controller CONT, that is, when the controller is operated, it is discriminated whether or not the phase is a final step (the third step) for stitching a bar tack of the button hole stitching and the finish-up stitching. If this is not the final step, it is discriminated if a pattern is stitched which is selected by one of the pattern selecting switches S0–S11 or a series of patterns are stitched which are produced in one cycle by operating desired pattern selecting switches and a memorizing switch S14. If a pattern is determined to be stitched, the corresponding indication lamp is lighted, and the machine motor SM is started. If a series of patterns, which are stitched in a cycle, are selected, these patterns are sequentially stitched with the indication lamps lighted and extinguished one after another. If the phase is to stitch the final third step of the button hole stitching, the number of stitches produced in the first and second steps are registered as so many stitches for the automatic button hole stitching. In this case, there occur the discrimination of said memorized patterns and the process of changing the pattern indications. The button hole stitching including the process of registering said stitching number is shifted to the automatic button hole stitching when the final third step is finished, if the sewing machine is continuously operated without pushing the button hole switch S11**. The speed of the machine motor SM is adjusted by operation of the controller CONT to meet the stitching operation, and also the maximum permissible speed of the machine motor is determined in dependence upon the pattern to be stitched. Then it is discriminated if the machine motor SM is energized or not, so as to deal with the machine motor when the latter is restrained. If the machine motor SM is energized, it is discriminated whether or not the detecting timer is at the determined value, that is, whether or not the machine motor has been restrained for a certained time after the preceding phase discrimination. If restrained, the machine motor is deenergized. If the timer is not at the determined value, that is, if the sewing machine is rotated at the time of discriminating the phase-change and the timer is reset, the machine motor is not made deenergized, but circuits are operated to reduce the electric power of the pulse motor PWw, $PM_F$ and also to prevent the temperature rise of the pulse motors PMw, $PM_F$. In the discrimination of the machine motor when it is deenergized, the timer is reset and the power reducing circuit is made operative. These circuits are included in the pulse motor driving devices DVw, $DV_F$ respectively. When the electric power of the pulse motors is reduced, the program returns to a returning point A to repeat the program from the step where the lamp is turned OFF.

If the needle upper position detector $PD_H$ issues a signal of H level, it is discriminated if it is necessary to change the needle dropping hole from the reduced straight stitching hole to the elongated pattern stitching hole and vise versa. If it is necessary, a needle dropping hole changing program is carried out and the program is returned to B. The change of the needle dropping hole from the elongated zigzag stitching hole to the reduced straight stitching hole is performed by operating the solenoid at this needle phase and by driving the pulse motor PMw. If the needle dropping hole switching discrimination or the actual switching is made, it is discriminated if this is the initial address of the selected pattern, and the subsequent routine is performed as will be mentioned hereinafter. On the other hand, if the needle upper position detector $PD_H$ produces a signal indicating the change from L to H level, this signal indicates the needle swinging control phase, and therefore it is discriminated if the needle dropping hole is switched in dependence upon the selected pattern. If the needle dropping hole switching is necessary, this is done and the brake is prepared, and then the program is returned to the point B. If this is not necessary, that is, if the adjusting dial $S_B$ is manipulated to operate the switch 70 for the basting stitch, the brake is prepared to enable the sewing machine to stop during every rotation by operating the machine controller CONT to ON and then to OFF repeatedly, and then the program is returned to the returning point A. When the basting stitch is not required, it is discriminated whether or not the reversing stitch is ordered by the switch 12, and when the reversing stitch is not required, it is discriminated whether or not the button hole stitching is order by the switch S11, and when it is not ordered, it is discriminated whether or not the finish-up stitching is ordered by the switch SO; when this is not ordered, it is discriminated whether or not a series of memorized patterns is ordered by pattern selecting switches including the switch S14, and when it is not so ordered, the pattern data of ROM is read out at the needle swinging amplitude phase, that is, at switching to a signal of H level. Thus the ROM is addressed in this process during each switching to H level per rotation of the sewing machine and this address advances. When the reversing stitch is designated, this discrimination process is omitted. When the button hole stitching is designated and if this designation is not the final third step of the button hole stitching (i.e., a step before shifting to the automatic button hole stitching), this is a button hole stitching step to be exercised per every operation of the button selecting switch S11, and 1 is added to a counter (not shown) counting the number of line tack stitches. Thus the stitch number is counted, and if it is not the set value (the maximum possible counting value of the counter in the button hole stitching by the initial manual operation) of the registration of the stitch number at that step stitching number, and then if the switch S11 for newly changing the step of the button hole is not operated, the ROM is forwardly read out until the set value is reached to produce the line-tack stitches, and then the next step of the button hole stitching is reached. When the switch S11 is newly operated, the discrimination as to the setting value is done and the next subordinate button hole step is reached. This routine is the same for the automatic button hole stitching except for stitching the third step thereof. In this case, the value of the stitch number in every step is used which is registered upon starting the automatic button hole stitching. At the third step, the data of ROM is read out until finishing said step to advance the stitching and when this advance is finished, the brake is prepared, and then the program is returned to B. If the finish-up stitching is ordered, the stitching is advanced to perform one cycle, and when this is finished the same pattern is repeated and the braking is prepared and then the program is returned to B. When a series of patterns is designated including the finish-up stitches, this set of patterns is repeated, and then the brake is prepared. In this case, the finish-up stitch number is set 4 stitches, and the needle dropping points are only slightly changed to treat the stitching termination. The stitching speed of the finish-up stitches is set at the ultra low speed by the speed control of the machine motor SM irrespectively of the operation degrees of the controller CONT. When the machine motor SM is braked and stopped, this is the OFF position of the machine motor SM in FIG. 7, enabling the sewing machine to repeatedly stitch the same pattern or patterns. Namely by operating the finish-up stitching switch button SO, the present stitching is interrupted to be replaced by the finish-up stitching. When this shifting is finished it is shifted to the initial stitching of the pattern which had been selected. If a series of patterns is to be stitched after the discrimination "NO" at the finish-up stitch, the plural patterns are sequentially memorized in accordance with the switch data treatments. Reading out of ROM is advanced until one pattern (one cycle) of them is finished, and when the one cycle is finished, the next memorized pattern is stitched. The discrimination as to the initial address after the pattern selection is made when the needle is at the upper position to assure that the designation of the stitch control signal of the pattern or the initial pattern of a series patterns corresponds to the initial address. If the initial address is correct, the static memory ROM is read out, and the address is advanced by one. Therefore the subsequent discrimination becomes "NO". When the needle lower position detector $PD_L$ issues a signal switching from L level to H level, this indicates a feed control phase, and it is discriminated whether it is necessary to lower the feed dog under the needle plate 9 or to return the feed dog to the operative position as designated by operation of the fabric pressure adjusting dial $S_B$ or of the button S15 lowering the feed dog, and if necessary, the feed dog switching program is exercised to lower the feed dog or return it. If not necessary, it is discriminated that this is not any of the basting stitch, the button hole stitching and the finish-up stitching. If it is a reversing stitch, the pattern data of ROM is read out at the feeding phase, i.e. at switching to H level. The address of ROM is treated in this process on switching from L to H level per every subsequent rotation of the sewing machine, and is backwardly addressed. In case of any of the basting and button hole stitching and the finish-up stitching, or when the reversing stitch is not designated, this process is omitted. If it is a series patterns, the reading-out of the backward of ROM is advanced until one cycle is finished as in the amplitude control phase, and when one cycle is finished, it is shifted to the preceeding pattern and this is indicated. When the pattern data is read out for the normal and reverse feeding at the amplitude control phase and the feed control phase, the data is multiplied, as coefficient, by the automatically set value or the value converted to digital from the resistance value designated by the adjusting values of the dials VRw, $VR_F$ adjusting the stitching width and the stitching length. By this calculation, the pattern data are adjusted with respect to the stitch width and the stitch length in proportion to all the stitches by the program which is repeatedly exercised per every subsequent rotation of the sewing machine, and determine new stitch coordinates. When a twin needle selecting switch S16 is operated this program is, though omitted in detail, effected with a multiplication of a further reduced coefficient to said coefficient. The data of adjusting dial VRw is read out by the declining signal of the needle upper position detector $PD_H$ (i.e., the falling after the braking phase detecting signal by generating a braking phase detecting edge 8B of the photointerrupter 8), and the dial $VR_F$ is read out by the falling signal of the needle lower position detector $PD_L$, but is always read out when the sewing machine is at a standstill. If it is found that the read out results are different from the initially read out data or the previous data read out in this process, the results are registered, and then the program is returned to B, and these results become new coefficients to be multiplied to the original data. Then a subtracting calculation is made in relation to the existing positions of the stitch control mechanisms W, F in order to set these mechanisms into the respective new positions. That is, the difference is calculated between the existing coordinates and the new ones of these mechanisms to determine the control step numbers of the pulse motors PMw, $PM_F$. In this case, it is discriminated whether or not the necessary step number is 0 in order to move these pulse motors only when there is a difference between the existing and the new positions thereof. When the step number is not 0, an order is given to move the pulse motors by one step to a direction to be determined by whether the difference is positive or negative. If the calculation is not 0 (the stepping number of driving the motor), the time until the next energization of the motors is set to move them a next step, and the interrupting routine in FIG. 7 is performed at the termination of said time. After the timer T is set, the program is returned to the point B. If the calculation is 0, the program is returned to the point B without the set of timer T. In the routine after the returning point B, it is discriminated whether the timer T is operating, and if it is at operation, the needle phase and the needle moving phase are not checked, and each of the processes is performed until the power of the pulse motors is reduced. In the meantime, if the set time of the timer T is past, the interruption in FIG. 6 starts. Since the brake interruption after the change from ON to OFF of the controller CONT is never effected in this needle phase, the drive interruption of the pulse motors is confirmed. As a result, if the required step is not 0, the energization time of the pulse motors is set. If it is 0, the program returns to the interruption generating point RET with no energization time set of the motors (since this returning point is not constant, it is not described in the main program). If the required step of the pulse motors is not 0, the interruption routine is effected until the step becomes 0 to rotate the pulse motors PMw, $PM_F$ as required, thereby to control the stitching coordinate and form a stitch. When the controller CONT is switched from ON to OFF, said braking is prepared, and this is confirmed by the braking phase control signal generated by the detecting edge 8B of the photointerrupter 8. Thus it is confirmed that the machine motor SM is slow enough to be braked, and a braking order is given to the gate control part CCg of the machine motor control circuit CC. This order is cancelled after a certain time and the timer T is set for effecting the brake interruption routine, and the program returns to the returning point B. The program does not enter the braking operation but returns to the returning point B when the braking is not prepared and the machine motor SM is not at the stopping speed. When the interruption routine is effected after a certain time, the brake interruption is confirmed and the machine motor SM is switched to OFF and the program returns to the interruption generating point RET, because the stepping interruption of the pulse motors PMw, $PM_F$ will not be effected when the braking timer T is reset. The operation of the control circuit CC by said braking order is as follows: In the brake operation process, the machine motor control thyristors SCR1, SCR1 become conductive at the maximum conduction angle to make conductive the brake control thyristor SCR2. The electric power of an armature A generated by the field magnet FC receiving the strong energization of the thyristers SCR1 is consumed by a circulating electric current flowing through the diode D1, the field magnet FC and the thyrister SCR2, thereby to provide a power braking. The electric current flowing in this field magnet FC become a self-energizing power to make the thyristers SCR1 nonconductive in the process of the machine motor to be deenergized. When the machine motor SM is stopped, the thyrister SCR2 becomes unconductive, and the braking operation is finished.

The basting stitch will now be explained: If the fabric presser adjusting dial $S_B$ is operated to select the basting stitch, the data is processed. As the controller is not ON, the program returns to the point A and the basting stitch indication lamp LB is lighted. If the machine motor SM is at a standstill and the feed dog 28 is at the operative position, the program lowers the feed dog into the inoperative position and returns to the point B. On the other hand, if the needle is at the upper position and the needle dropping hole is the laterally elongated one, the hole is changed into the reduced circular hole for straight stitching. If the basting stitch is selected while the machine motor SM is rotating, the needle upper position detector $PD_H$ becomes H level to indicate the needle swinging control phase when the needle comes to the position above the needle plate 9 after the initial vertical reciprocation. When the needle dropping hole is the laterally elongated one, the hole is changed into a reduced circular hole for straight stitching, and the brake is prepared, and the program returns to the returning point B. In the subsequent braking control phase, the braking is prepared in advance and the braking order is issued to the gate control part CCg since the rotation is low. This order is cancelled after a certain period of time, and then the timer T is set for effecting the brake interruption routine in FIG. 7, and the program returns to the returning point B. The interruption is started after a certain period of time, and the interruption routine is effected. Since this is a brake interruption, this causes the gate control part CCg to make the thyristors SCR1, thereby to cut off the power source of the machine motor SM. At the same time, the thyristor SCR2 is also made OFF, and thereafter the power generating current of the machine motor SM flowing through the thyristor SCR2 is a holding current of the thyristor. When this power generating control is finished, that is, when the machine motor SM is stopped, the thyristor SCR2 is self-extinguished to finish the braking operation. This stopped position of the machine motor corresponds to the upper dead point of the needle suitable to the manual feeding of the fabric to be sewn. When the sewing machine is stopped and the controlled CONT is made OFF, the braking preparation, the speed control of the machine motor, and the routine return to the point A are effected. But the sewing machine is stopped since the starting order of the machine motor SM is not given. When the controller CONT is made ON, the machine motor SM starts and is driven at the ultra low speed, and when the needle 6 penetrates the fabric and the detector $PD_L$ is switched from L to H, this is the fabric feeding control phase. If the feed dog 28 is in the operative position, the feed dog is lowered under the needle plate 9 to make the same inoperative, and the program returns to the point B. Subsequently when the amplitude control phase is reached the change of the needle dropping hole is finished, and since the basting stitch is designated, the braking is prepared and the brake is operated at the braking control phase and the sewing machine is stopped at the upper dead point of the needle. Every time the controller CONT is made ON, the sewing machine is rotated once at a low speed and stops at the upper dead point of the needle. Since the switching of the feed dog is finished at the following feed control phase, a new coordinate is determined and a routine thereafter is performed, but this is for reading out the pattern data of ROM which is the preceding process in the needle amplitude control phase and for causing the pulse motors PMw, $PM_F$ to control the stitches of the normal pattern of the sewing machine together with the routine after "NO" of the brake interruption in the interruption routine. In this embodiment, the stitching control is not carried out, that is, it is discriminated that the step number is always 0, and then the program returns to the point B.

Next, reference will be made to the finish-up stitching. When the finish-up stitch selecting button S0 is operated, in the straight stitching operation, the finish-up stitches are produced in relation with the straight stitches. That is, the switch S0 is detected and the indicating lamp is lighted, and the lamp is extinguished which has indicated the straight stitching.. When the needle penetrates the fabric, the detector $PD_H$ is L level, and when the controller CONT is switched to ON, the machine motor SM is started and the sewing machine is driven at a low speed for the finish-up stitches. The needle is then positioned at the center of the lateral swinging amplitude thereof, irrespectively of the pattern selected. However, stitching is normally started when the needle is above the needle plate, that is, since the detector $PD_H$ is at H level, it is discriminated if the initial address is designated when selected firstly, and if it is the initial, the pattern data is read out before the controller CONT is made ON in order to determine the needle position (at this time at the center position of the lateral maximum amplitude) and the initial fabric feed for the finish-up stitch, and thus, a new coordinate of the needle lateral swinging amplitude is determined. The calculation is effected as to the difference between the existing needle position and the new coordinate to determine the stepping number of the needle position control pulse motor PMw. Then it is discriminated whether or not the necessary stepping number is 0 in order to move the motor only when there is a difference. If it is not 0, a signal is given to move the pulse motor PMw one step in the direction determined by whether said difference is positive or negative. If the calculated result (the stepping number to move the motor) is not 0, a time is set until the next energization of the pulse motor to move said motor by one more step, and after the set time has elapsed, the interruption routine in FIG. 7 is effected. After the time T is set, the program returns to the point B. If it is 0, the program returns to the point B without setting the timer, and the routine is effected until the machine motor SM is controlled, and the program returns to the point A. In the routine after the return point A, it is discriminated that the timer T is operating. If it is operative, the process is carried out until the speed control of the machine motor without checking the needle phase and without discriminating the needle moving phase. In the meantime, when the set time of the timer T elapses, the interruption routine starts. It is confirmed that this is the pulse motor drive interruption, and as a result if the required step of the motor is not 0, the energizing time is set, and if it is 0, the program returns to the interruption generating point RET without setting the energizing time. Then the interruption routine is effected until the step becomes 0 to rotate the pulse motor PMw as required, thereby to determine the needle position for the straight stitching (the center position of the needle lateral swinging amplitude). When the controller CONT is switched ON, the sewing machine is rotated at a lower speed, and the discriminations are made of the signals of the detectors $PD_H$, $PD_L$, $PD_B$. For example, since a lateral mentioned braking control is not prepared, the braking is not effected, and a new coordinate is determined for the first feed of the finish-up stitch which is read out from ROM at a subsequent feed control phase when the detector $PD_L$ changes from L level to H level, and the feed adjuster 22 is regulated by the feed control pulse motor $PM_F$ just as in controlling the needle lateral amplitude. When the needle amplitude control phase, i.e., the detector $PD_H$ reaches the phase from L level to H level, the pattern data is read out for a next finish-up stitch (in this case, finished with four stitches). The needle amplitude and the fabric feed are controlled, and the pulse motor PMw is driven at the amplitude control phase and the pulse motor $PM_F$ is driven at the feed control phase. At the finish-up stitch, only the fabric feed is controlled a very little in the backward and forward direction, and the data for the needle lateral amplitude is nullified in the process determining the new coordinate, and the pulse motor PMw is not driven. After one cycle of finish-up stitches (four stitches) has been produced, a pattern, that is straight stitch pattern that has been selected, is stitched and the corresponding indication lamp is lighted and at the same time the brake is prepared, and then the program returns to the point A through the point B. At the phase where the braking control phase detector $PD_B$ changes from L level to H level, the brake is prepared, and then the sewing machine is rotated at a low speed and the brake is operated. That is, the braking order is given to the gate control part CCg of the machine motor control circuit CC. This order is cancelled after a certain period of time, and the timer T is set for effecting the brake interruption routine, and then the program returns to A through B. When the interruption routine is effected after a certain period of time, the machine motor SM is switched to OFF and the program returns to the interruption generating point RET. Then, the needle 12 of the sewing machine is stopped at the upper dead point. In this case, the finish-up stitches have been produced in relation to the straight stitches. In this respect, if a pattern is selected including the lateral swinging movement of the needle, the pattern data is read out and the indication is effected. At this time, if the detectors $PD_H$ is H level, the discrimination of the initial address of the pattern becomes "Yes" and the needle position coordinate is determined. Subsequently, if the finish-up stitch is selected, the program returns to the point A to read out the corresponding stitch data. Then if the controller CONT is switched ON, the sewing machine is rotated at a low speed. Each time the detector $PD_L$ changes from L level to H level, it slightly moves the feed dog in the forward and backward direction to produce the finish-up stitches. When one cycle of the finish-up stitches is finished, the sewing machine is topped at the upper dead point of the needle, and the program is repeated to produce the initial stitch of the pattern.

Next, reference will be made to the finish-up stitching by operating the selecting button S0 while the pattern is stitched, including the lateral swing movement of the needle. A desired pattern is selected by one of the selecting buttons S1–S11 and the controller CONT is switched ON. The sewing machine is driven at a speed determined by the controller CONT and the selected pattern is started. The pattern data of ROM is read out at the needle position control phase and the pulse motor PMw is driven at this phase and the needle amplitude is controlled, and the pulse motor $PM_F$ for controlling the fabric feed is driven so that the fabric feed is controlled. When the finish-up stitch selecting button S0 is operated on the halfway completion of stitching a different pattern, the pattern indicating lamp is extinguished and the finish-up stitch indicating lamp is lighted, and the sewing machine is rotated at a low speed, and the finish-up stitch is discriminated at the needle control phase. Then the pattern data of ROM is read out to control an initial fabric feed for the finish-up stitch. At the determination of the new coordinate after reading out ROM, the data of controlling the needle amplitude is nullified and the pulse motor PMw is not driven and the needle is located at the position where it remain before the selection of the finish-up stitch. When one cycle of the finish-up stitches is finished, the pattern which had been selected is to be formed again, and the corresponding indication lamp is lighted and the finish-up stitch indication lamp is extinguished, and the sewing machine is stopped at the upper dead point of the needle.

The operation of the finish-up stitch at the termination of series patterns will be explained. In this case, two or more pattern selecting switches S1–S11 are operated, and finally the finish-up stitch selecting switch S0 is operated. More precisely, one pattern selecting switch is operated, and then the memorizing switch S14 is operated. Subsequently another pattern selecting switch is operated, and then the memorizing switch S14 is operated. Thus a desired number of pattern selecting switches are operated, and finally the finish-up stitch selecting switch S0 is operated, and then the memorizing switches S14 is operated. As a result, the address signals for the initial stitch control signals of the selected patterns and the finish-up stitches are sequentially transferred into the random access memory RAM. If the detector $PD_H$ is H level at the time of pattern memorizing operation, the discrimination is made only to the initial address designation of the initially selected pattern, in the same manner as mentioned hereinbefore. Thus the corresponding initial stitching data is read out from the ROM to drive the needle position control pulse motor PMw, so as to shift the needle 6 to the initial stitching position of the initially memorizing pattern. Therefore if the controller CONT is switched ON, the start of the initially memorized pattern is discriminated and the corresponding indication lamp indicates the first pattern, and the machine motor is started and the sewing machine is driven at a speed determined by designation of the controller CONT. The feed control pulse motor $PM_F$ is driven at the feed control phase and the needle position control pulse motor PMw is driven at the needle control phase in accordance with the pattern data of ROM read out until the initial pattern is formed up. When the first pattern is completed, the next memorized pattern is stitched. When the selected patterns are all finished and the finish-up stitch comes as the finally memorized pattern, the finish-up stitch indicating lamp 7 is lighted. Then the needle swinging data is nullified at the determination of the new stitch coordinate by the pattern data read out from the ROM, and the needle is located at the last position of the preceded pattern. The sewing machine is rotated at a low speed for the finish-up stitch, and the feed control pulse motor $PM_F$ is driven as mentioned. If one cycle of the finish-up stitch is finished, the program returns to the initially memorized pattern and the brake is prepared and is operated at the brake control phase, and the needle 6 is stopped at the upper dead point and the first pattern is indicated.

We claim:

1. A sewing machine having an electric machine motor driven by a manually operated controller, stitch forming instrumentalities including a needle driven by the machine motor to vertically reciprocate so as to penetrate a fabric to be sewn and a fabric feeding device driven by the machine motor in synchronism with the needle to feed the fabric relative to the movement of the needle, fabric presser means manually adjusted to press the fabric against the needle plate at a set pressure, and electronic memory means storing stitch data sequentially read out to control the needle position and the fabric feeding position, comprising electromagnetic drive means (PMw) operated by the stitch data of the memory means to control the needle position; another electromagnetic drive means ($PM_F$) operated by the stitch data of the memory means to control the fabric feeding position; means manually operated to adjust the fabric presser means to press the fabric with a suitable pressure for basting stitches and generating an electric signal at a predetermined set position; control circuit means (CC) activated by operation of the controller to drive the machine motor at a reduced speed and to stop the machine motor after one complete rotation thereof with the needle stopped at the upper dead point thereof; switching means operated by one of the electromagnetic means to make the fabric feeding device inoperative; and data processing means (CPU) detecting the electric signal of the fabric presser adjusting means to perform calculations and treatments of the results by means of the programing data stored in the memory, thereby to produce orders to operate the control circuit means and the switching means.

2. A sewing machine having an electric machine motor driven by a manually operated controller, stitch forming instrumentalities including a needle driven by the machine motor to vertically reciprocate so as to penetrate a fabric to be sewn and a fabric feeding device driven by the machine motor is synchronism with the needle to feed the fabric relative to tfhe movement of the needle, fabric presser means manually adjusted to press the fabric against the needle plate at a set pressure, and electronic memory means storing stitch data sequentially read out to control the needle position and the fabric feeding position, comprising electromagnetic drive means (PMw) operated by the stitch data of the memory means to control the needle position; another electromagnetic drive means ($PM_F$) operated by the stitch data of the memory means to control the fabric feeding position; means manually operated to adjust the fabric presser means to press the fabric with a suitable pressure for basting stitches and generating an electric signal at a predetermined set position; control cirucit means (CC) activated by operation of the controller to drive the machine motor at a reduced speed and to stop the machine motor after one complete rotation thereof with the needle stopped at the upper dead point thereof; switching means operated by one of the electro-magnetic means to make the fabric feeding device inoperative; data processing means (CPU) detecting the electric signal of the fabric presser adjusting means to perform calculations and treatments of the results by means of the programing data stored in the memory to thereby produce orders to operate the control circuit means and the switching means; pattern selecting means including a plurality of pattern selecting switches (S1–S11) selectively operated to produce the stitch patterns; finish-up stitching switch means (S0) operated prior to the selective operation of the pattern selecting switches (S1–S11) or after the selective operation of the pattern selecting switches to produce a predetermined number of stitches accompanied by only slight fabric feeding variations, said data processing means (CPU) designating the operation of the finish-up stitching switch means to be effective prior to or after the operation of the pattern selecting switches by means of the programing data stored in the memory, said data processing means designating the needle to the initial needle position coordinate of the pattern after the finish-up stitches have been formed up, and designating the needle to the last needle position coordinate of the pattern prior to initiating the finish-up stitches; and machine motor control circuit for stopping the sewing machine with the needle stopped at a predetermined position in accordance with the data treatment of the data processing means (CPU) after the finish-up stitches have been formed up.

* * * * *